US007044219B2

(12) United States Patent
Mason et al.

(10) Patent No.: US 7,044,219 B2
(45) Date of Patent: May 16, 2006

(54) SHOCK ABSORBER

(75) Inventors: Guy Harvey Mason, Hampshire (GB); William Peter Stuart-Bruges, Hampshire (GB); Thomas Lempriere Searight, London (GB); Ian Hitchcock, Berkshire (GB)

(73) Assignee: Sondex Limited, Hampshire (GB)

( * ) Notice: Subject to any disclaimer, the term of this patent is extended or adjusted under 35 U.S.C. 154(b) by 186 days.

(21) Appl. No.: 10/476,919

(22) PCT Filed: May 3, 2002

(86) PCT No.: PCT/GB02/02082

§ 371 (c)(1),
(2), (4) Date: Oct. 31, 2003

(87) PCT Pub. No.: WO02/090715

PCT Pub. Date: Nov. 14, 2002

(65) Prior Publication Data

US 2004/0140090 A1 Jul. 22, 2004

(30) Foreign Application Priority Data

May 3, 2001 (GB) ..... 0110905.7

(51) Int. Cl.
*E21B 17/07* (2006.01)
*F16F 7/116* (2006.01)

(52) U.S. Cl. ..... 166/242.1; 166/55.1; 166/297; 188/380

(58) Field of Classification Search ..... 175/320–322, 175/299, 293; 188/378–380; 166/242.1, 166/55.1, 297
See application file for complete search history.

(56) References Cited

U.S. PATENT DOCUMENTS 2,905,458 A * 9/1959 Mason ..... 267/128

(Continued)

FOREIGN PATENT DOCUMENTS

CA 2 314 192 3/2001

(Continued)

OTHER PUBLICATIONS

Search Report for UK Application No. GB 0110905.7, dated Oct. 22, 2001 (1 page).

(Continued)

*Primary Examiner*—Kenneth Thompson
(74) *Attorney, Agent, or Firm*—Flynn, Thiel, Boutell & Tanis, P.C.

(57) ABSTRACT

A shock absorbing tool for use in pipelines and oil wells, particularly in combination with perforation guns comprises a central mass supported on two springs between the end terminal members. The shock wave is absorbed in the free oscillation of the mass. The mass is constituted by a piston assembly. A steel rope permits the shock absorbing tool to be maneuvered within the bore hole without damage to the springs.

21 Claims, 4 Drawing Sheets

U.S. PATENT DOCUMENTS

| | | | | |
|---|---|---|---|---|
| 4,413,516 | A * | 11/1983 | Croom et al. | 73/431 |
| 4,552,230 | A | 11/1985 | Anderson et al. | |
| 4,817,710 | A | 4/1989 | Edwards et al. | |
| 5,320,169 | A | 6/1994 | Delatorre | |
| 5,799,732 | A | 9/1998 | Gonzalez et al. | |
| 6,109,355 | A | 8/2000 | Reid | |
| 6,412,614 | B1 * | 7/2002 | Lagrange et al. | 188/281 |
| 6,471,198 | B1 * | 10/2002 | Herbst | 267/293 |
| 2005/0011714 | A1 * | 1/2005 | Menzel et al. | 188/380 |

FOREIGN PATENT DOCUMENTS

| | | |
|---|---|---|
| EP | 0 170 771 | 2/1986 |
| EP | 0 261 291 A | 3/1988 |
| EP | 0 414 334 A | 2/1991 |
| EP | 0 489 527 | 6/1992 |

OTHER PUBLICATIONS

Search Report for UK Application No. GB 0210306.7, dated Jun. 14, 2002 (1 page).

Search Report for French Application No. FR 0205501, dated Nov. 28, 2003 (2 pages).

* cited by examiner

SHOCK ABSORBER

BACKGROUND OF THE INVENTION

This application relates to a shock absorber apparatus for use as part of a tool string for use in bore holes and/or pipelines. This invention particularly though not exclusively relates to a shock absorbing tool for use with perforating guns in the oil well logging industry.

Present day wells for extracting oil, gas or water, are mostly constructed by drilling in the ground and placing a tubular steel casing as a liner in the well. Once the casing is in place, the well may be completed using a perforating gun to form perforations in the casings through which surrounding reservoir fluid, comprising oil, gas and water, may flow inwardly. From this reservoir fluid, the oil, gas or water may then be extracted.

A perforating gun is an instrument equipped with a number of powerful explosives or 'shape charges'. These are about one inch (25 mm) in diameter, and when detonated produce a plasma which destroys both the steel pipeline casing and typically 1 to 2 feet (300–600 mm) of the surrounding rock. Reservoir fluid from a deposit surrounding the well can then flow through the perforated rock into the pipeline and be pumped away to the surface.

It is desirable to deploy sensors such as temperature and pressure sensors alongside the perforating gun so that data about the 'perforating' explosion and the resulting fluid flow may be collected. In this way perforation techniques may be improved.

The perforating gun and sensor tools may be deployed in the bore hole as or as part of a tool string, which is an array of one or more guns or tools connected end-to-end on a wireline or cable. The wireline may provide both electrical power and a possible mechanical drive means for the tool string in the bore hole.

The blast from the shape charges of the perforating gun is powerful enough to rip through both the steel casing and enough of the surrounding rock to release the reservoir fluid. The blast therefore poses a significant risk of damage to the sensors that accompany the perforating gun into the bore hole. Such sensors often employ photo-multipliers, gamma ray detectors and circuit boards which could easily be damaged by the shock wave from the explosion. For this reason, it is desirable to separate the tool sensors and perforating gun from one another on the tool string by a shock absorbing tool. A good shock absorber is important as it means that the sensor tools may not only be protected from the shock wave but also may be placed closer to the perforating gun in order to collect data closer to the explosion site.

A number of shock absorbers for use down-hole in an oil well are known and rely on a piston or plunger mechanism to absorb the energy from the shock. Typically the piston or plunger chamber is filled with a fluid which is forced through holes in the piston chamber as the piston is depressed, providing an increasing resistive force in opposition to the force which is depressing the plunger or piston. A problem with shock absorbers of this type is that they are not responsive enough to adequately dissipate the energy released from the explosion. This is because the blast from the shape charges lasts only an instant and produces a shock wave that contains both high and low frequencies. At high frequencies, the piston and fluid arrangement simply cannot react quickly enough and the shock wave may travel through it as if it were a solid. As a result the sensors may be damaged A prior art shock absorber tool for use in an oil well is described in European patent application 0,414,334. This shock absorber comprises a piston and a fluid filled piston chamber which has a number of openings to allow fluid to escape from the chamber into a surrounding space as the piston is compressed. As the piston moves into the piston chamber the hole area through which the fluid can escape is diminished resulting in an increasing resisting force from the fluid. An additional like shock absorber can be connected in series with it.

European patent application 0,489,527 discloses a further shock absorbing tool which makes use of two telescopic casings disposed one inside the other and defining a space between them which is filled with a compressible oil. Disposed between the two casings is a metering clearance sleeve which defines two spaced sealed voids in this space and through which the oil is caused to pass in response to a shock wave.

U.S. patent application Ser. No. 5,320,169 discloses a gauge carrier having shock absorber means. The shock absorber means comprises an upper set of belleville springs or disc springs mounted on a rod member and contained between an actuator head portion of the rod member and an annular disc support. A lower set of belleville springs is contained between the disc support and a lower connector member. The rod member is screwed into a threaded bore in the connector member.

Further shock absorbing devices are disclosed in U.S. Pat. Nos. 6,109,355 and 4,817,710 which use an elastically deformable body, and resilient contact pads, respectively.

We have appreciated that known shock absorbers, such as those described in the prior art referred to above, cannot respond quickly enough to adequately absorb the energy in a shock wave, and consequently that sensor tools used in conjunction with such shock absorbers and perforating guns are still at risk of damage from detonation of the shape charges.

SUMMARY OF THE INVENTION

The invention is set forth in claim 1 below to which reference should now be made. Advantageous features of the invention are set forth in the appendant claims.

A preferred embodiment of the invention, described in more detail below, takes the form of a tool comprising two terminal housings between which a body or mass is supported on two stiff springs. The mass, springs and housings are disposed longitudinally and the mass may freely oscillate on the springs between the two housings in response to the disturbance of a shock wave. The mass of the tool string connected to either of the terminal housings of the tool is significantly greater than that of the mass itself, and as a result, each collision of the mass with the terminal housing transmits only a small amount of energy from the oscillating mass to the rest of the tool string. Thus, much of the energy from the shock wave is delayed from transmission along the tool string.

While the mass oscillates, energy is also dissipated in the fluid surrounding the mass and spring system. In this way the frequencies of the explosion are separated out, some of the frequencies are delayed from transmission along the tool string, and some of the frequencies are lost to the surrounding fluid.

Preferably, the mass or body comprises a piston suspended on the two springs to provide a further dampening effect. The effectiveness of the piston may be increased by using deformable plugs inside the piston to absorb energy as the piston is compressed or as it is stretched.

Preferably, one of the terminal housings is also provided with a strong cable or wire rope which limits the maximum extension of the springs such that they are not extended beyond their yield point or elastic limit. This is advantageous when the shock absorbing tool, or the tool string on which it is mounted becomes stuck or jammed in the bore hole and a larger than normal force is required to free the tool or tool string. This force is borne by the cable or wire rope and not the springs where it might cause damage.

BRIEF DESCRIPTION OF THE DRAWINGS

The invention shall now be described in more detail by way of example and with particular reference to the drawings in which.

DESCRIPTION OF THE PREFERRED EMBODIMENT

A shock absorbing tool 2 according to the preferred embodiment of the invention will now be described with reference to FIG. 1. The tool is intended for use as part of a tool string in a bore hole or pipeline and is therefore elongate in shape and is provided with a male end terminal housing 10 and a female end terminal housing 20 so that it may be mechanically and electrically connected to other neighbouring tools in the tool string. The male and female terminal housings 10 and 20 are cylindrical in shape, have a diameter which is narrow in comparison to their length and are disposed apart from each other on the same longitudinal axis, being orientated so that the parts of the terminal housing which connect to adjacent tools in the tool string face away from each other.

Figure 1:
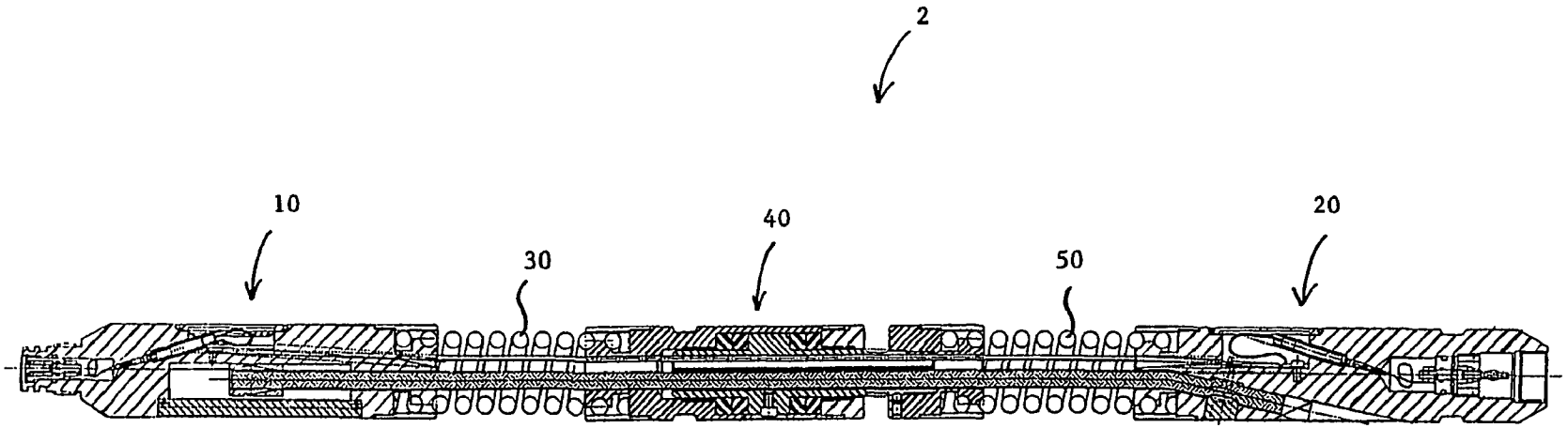
FIG. 1 is a longitudinal sectional view through a shock absorbing tool according to a preferred embodiment of the invention.

In the preferred embodiment shown in FIG. 1, the diameter of the terminal housings is approximately 50 mm; the length is approximately 250 mm.

Connected at one end to the inside end of male terminal housing 10 is a first spring 30 which extends along the longitudinal axis of the tool in the direction of the female end terminal housing 20 but the other end of which connects to one end of a piston assembly 40. A second spring 50 is connected at one end to the inside end of female housing 20 and extends longitudinally in the direction of the inside end of male terminal housing 10, connecting to the other end of piston assembly 40. Thus, the piston assembly 40 is supported between the two terminal housings 10 and 20 by the springs 30 and 50 so that the direction of movement of the piston is substantially aligned with the longitudinal axis of the tool.

As is clearly seen from FIG. 1, the terminal housings are each capable of independent movement in relation to each other. They are coupled together through the first and second springs, but are not joined by any rigid member. The springs keep the terminal housings separated from each other in the fluid in the borehole, and prevents them from touching during use.

Figure 2:
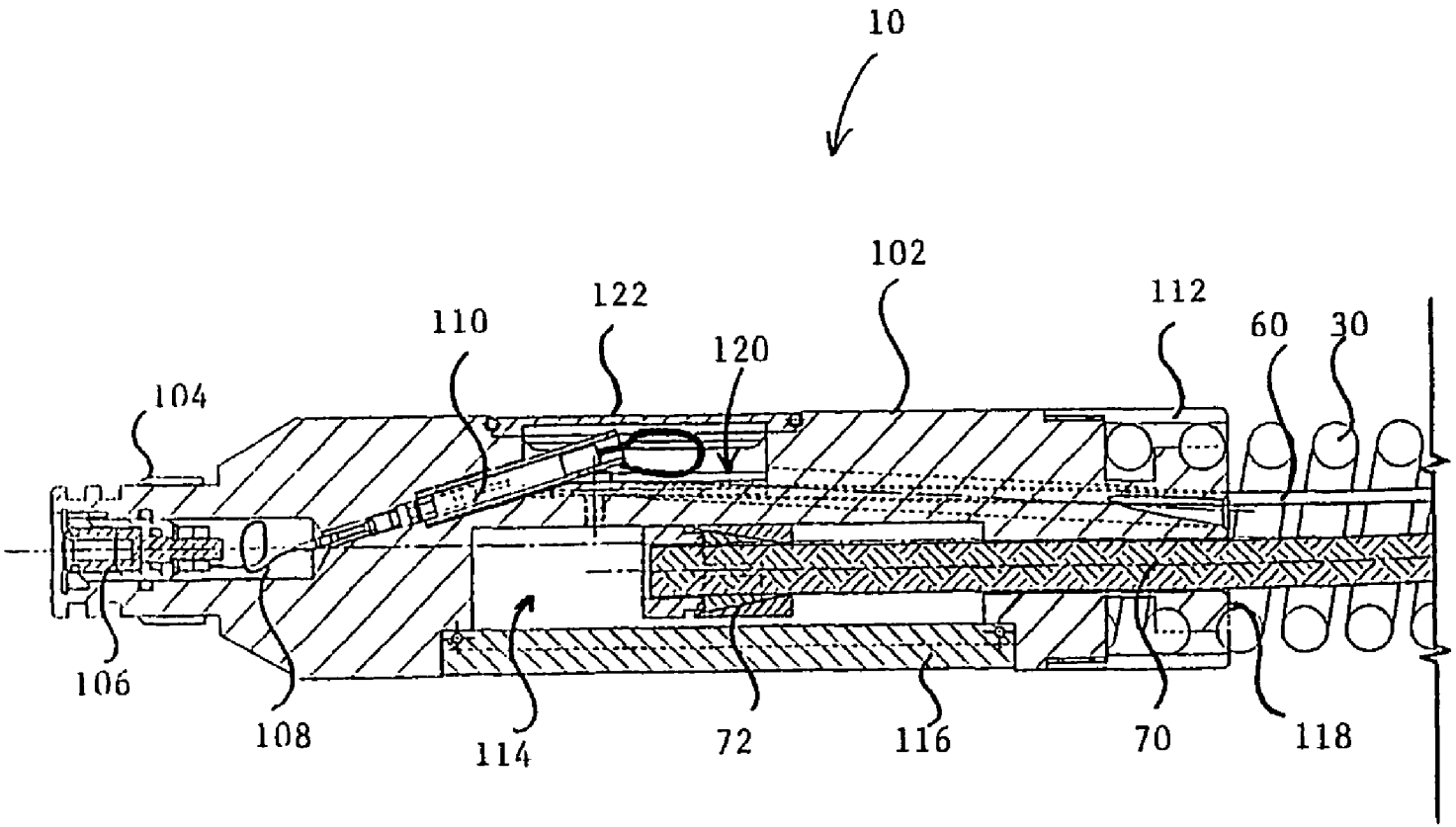
FIG. 2 is an enlarged view of the male end terminal housing of the shock absorbing tool shown in FIG. 1.

The male end terminal housing 10 of the shock absorbing tool 2 will next be described in more detail with reference to FIG. 2.

Male end terminal housing 10 comprises a cylindrical casing 102 which tapers at one end to bear a male type mechanical connector 104. This connector is so designed as to be accommodated within a female type mechanical connector of a neighbouring tool in the tool string to form a secure mechanical connection. Such a female type mechanical connector will be described later with reference to the female end terminal housing.

An electrical socket 106 is disposed within mechanical connector 104 and is designed to receive a corresponding electrical jack disposed in a female end terminal connector to form a secure electrical connection between the shock absorber tool and the neighbouring tool in the tool string. A wire 108 passes from electric socket 106 through pressure barrier 110 to cable 60. Pressure barrier 110 is housed in barrier housing 120 formed within the cylindrical casing and provides a pressure resistant barrier to shield the electric socket 106 and wire 108 from the high pressure 'wet' environment in the bore hole. Pressure barrier 110 may be accessed by an access panel 122. Cable 60 runs from the pressure barrier 110 and carries wire 108 along the length of the shock absorber tool to the female end terminal housing 20. As described below, wire 108 then connects to an electrical jack in the female end terminal housing in order to complete an electrical path through the shock absorbing tool. Such a path may be used for the transmission of electrical power to tools in the tool string, for the transmission of sensor data back from the sensor tools in the tool string, or even for powering detonating guns.

Some slack in the electric cable 60 is accommodated within barrier housing 120 to provide leeway for extension of the springs 30 and 50.

The first spring 30 is received within a spring mounting 112 located in the end of the cylindrical casing opposite that which bears the mechanical connector 102. Male end terminal housing 10 is also provided with a hollow longitudinal bore 114 which is accessible from the side via an access panel 116. Access panel 116 is received within a recess in the cylindrical casing of the male end terminal so that it lies flush with the housing surface. A stranded steel rope 70 is attached to a sliding anchor or mount assembly 72 disposed in the hollow bore 114 and able to slide along the length of the bore. Rope 70 passes out of the male end terminal housing through an aperture 118.

Figure 3:
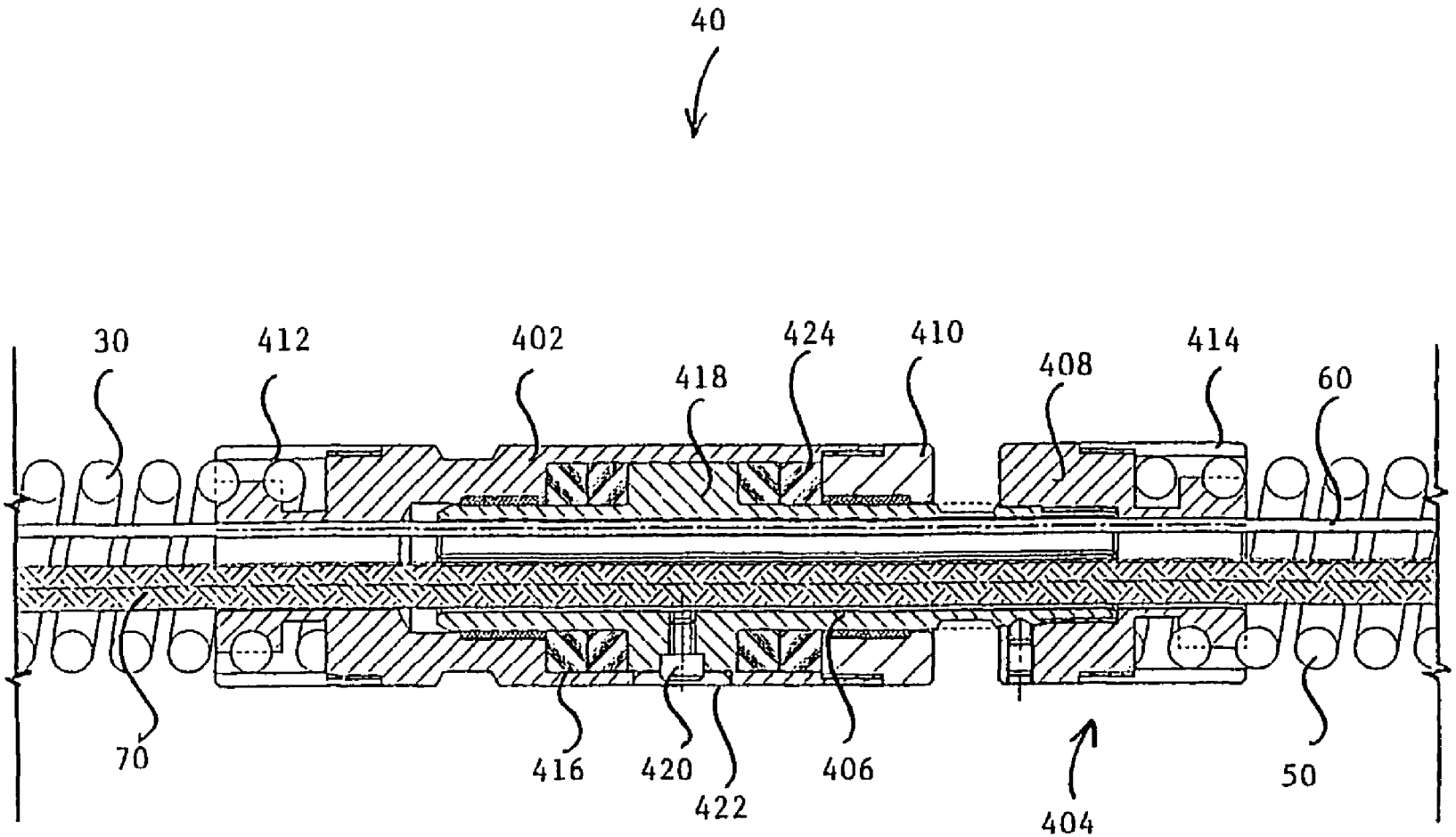
FIG. 3 is an enlarged view of the mass or piston assembly of the shock absorbing tool shown in FIG. 1.

The piston assembly 40 will next be described in detail with reference to FIG. 3.

Piston assembly 40 comprises a cylindrical piston casing 402 and a plunger 404. Plunger 404 has a piston rod 406 which fits inside piston casing 402 and a plunger head 408 which remains outside. Piston 418 is formed integral to piston rod 406 and is located within the piston casing 402. Piston casing 402 has a cap 410 through which the piston rod passes via a central aperture.

First spring 30 is received within spring mounting 412 disposed within the end of the piston casing opposite the cap 410. Second spring 50 is similarly received in a spring mounting 414 disposed within plunger head 408.

The diameter of piston rod 406 is smaller than that of the interior 416 of the piston casing 402. A central region of the piston rod has a ring or flange of greater diameter than the rest of the rod, which makes contact with the interior of the casing, and which forms piston 418. A securing pin 420 passes through a slot-shaped aperture 422 in the piston casing and is received in the piston 418 to prevent rotation of the plunger with respect to the piston casing. Rubber plugs 424, preferably made of Viton (RTM), are disposed in the annular recess formed where the diameter of the plunger is substantially less than that of the casing interior 416, and bear against a transverse wall at one end and the cap 410 at the other so as to provide a resistive force which opposes movement of the piston and plunger in either longitudinal direction. Although rubber plugs are preferred, the annular recess may alternatively be filled with any open-cell polyurethane foam, or suitable fluid.

Electric cable 60 and rope 70 pass through the centre of the piston assembly via apertures in the piston casing 402 piston rod 406 and plunger head 408.

Figure 4:
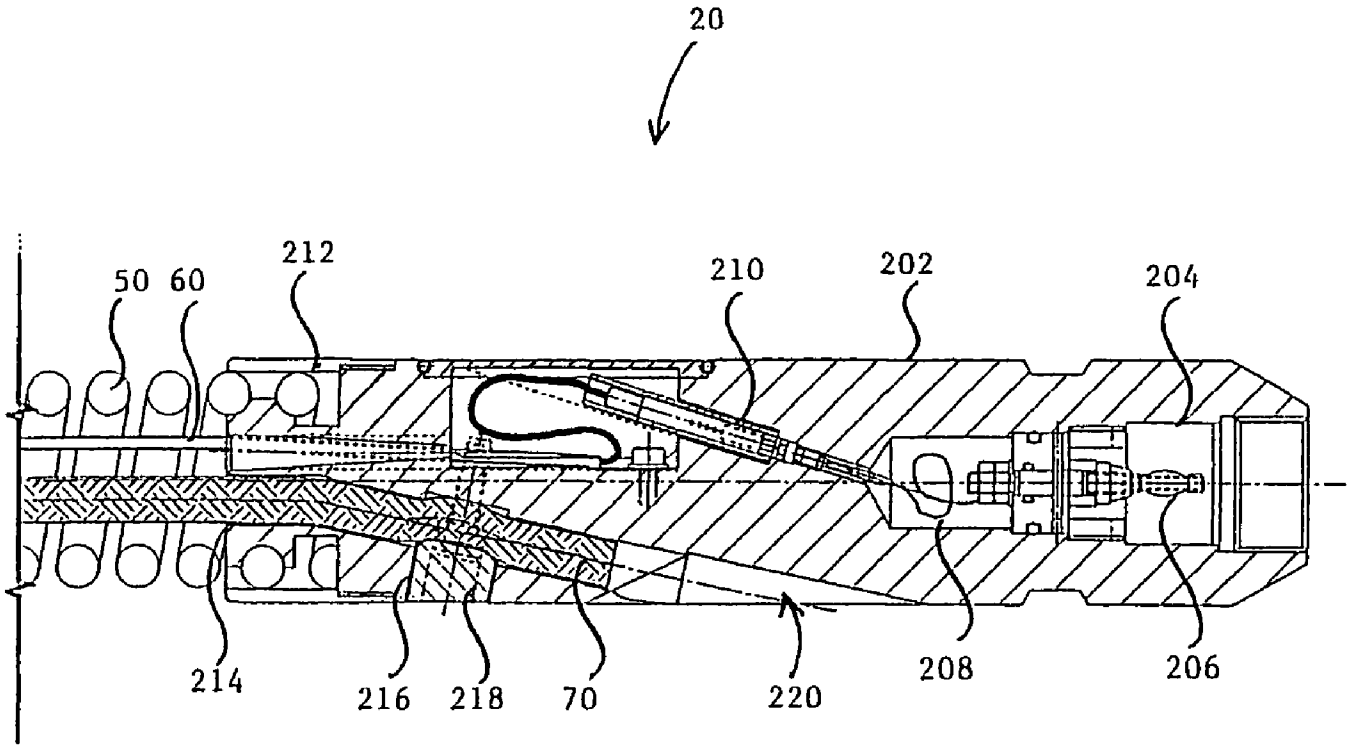
FIG. 4 is an enlarged view of the female end terminal housing of the shock absorbing tool shown in FIG. 1.

The female end terminal housing will next be described in detail with reference to FIG. 4.

Female end terminal housing 20 comprises a cylindrical casing 202 with a mechanical connector, being a socket 204, at one end to receive a male mechanical connector of a neighbouring tool in the tool string. It is otherwise generally similar to the male end terminal housing 10. Disposed inside socket 204 is an electrical jack 206 designed to connect with the electrical socket of the male end terminal housing of the neighbouring tool in the tool string to form a secure electrical connection. Wire 208 is connected to electrical jack 206 and passes through pressure barrier 210 to cable 60. It will be appreciated that wire 208 is equivalent to wire 108 in the male end terminal housing.

Second spring 50 is received in the female end terminal housing in a spring mounting 212 disposed at the opposite end of the housing to the socket 204. Stranded steel rope 70 passes from the male end of the tool, through piston assembly 40 and into the female end housing via an aperture 214, and is held in place in a retaining groove 216 in the cylindrical casing 202 by a retaining pin 218. The rope 70 which is on the opposite side of the retaining pin 218 to the first aperture 214 terminates in a second aperture 220 in the cylindrical casing of the female end housing.

The operation of the shock absorbing tool will now be described in detail with respect to the drawings.

The shock absorbing tool is preferably connected to the tool string on one side of a perforating gun by means of the mechanical connector 104 or socket 204 disposed on the end housings of the tool, so that any sensor tools or other sensitive apparatus may be isolated from the perforating gun. A second like shock absorber may be connected to the opposite side of the gun, or at any other position in the tool string as desired.

Referring now to FIG. 1, the operation of the device will be described in the case where the shape charges are detonated on a perforating gun connected directly to the male end terminal housing 10 of the device. Detonation of the shape charges will produce a brief but powerful explosion, resulting in a shock wave of high and low frequencies travelling along the shock absorbing device from the male end housing 10 in the direction of the female end housing 20. The movement of the shock wave will push the perforating gun and male end housing 10 against the central piston assembly 40, thereby compressing first spring 30. Spring 30 subsequently acts upon central piston assembly 40 causing it to move in the direction of the shock wave and thereby compressing second spring 50 against the female end housing 20. In comparison to piston assembly 40, however, female end housing 20 is not as free to move since it is connected to the rest of the tool string behind it. The mass of the piston assembly 40 is small in comparison with the rest of the tool string, and the collision of the piston assembly with the female end housing is for the most part elastic, due to spring 50. Therefore the piston assembly 40 rebounds back from the female end housing so as to travel in the opposite direction to the shock wave with only a small amount of the energy of the piston assembly being transmitted to the female end housing 20. Most of the energy is reflected back to travel back in the opposite direction.

The rebounding piston assembly now travels in the direction of the male end terminal housing 10, causing, as it does so, the first spring 30 to be compressed and the second spring 50 to be extended. As before, the mass of the male end housing and the tool string to which it is connected is much greater than the mass of the piston assembly and the piston assembly is reflected back towards the female end terminal housing with only a small percentage of the shock wave energy being transmitted to the male end housing. Thus, the piston assembly 40 oscillates backwards and forwards between the female end housing and the male end housing at a natural frequency dependent on the properties of the springs and the piston assembly. The frequencies of the shock wave which correspond to an integer multiple of the natural frequency of the oscillator are readily absorbed by the motion of the oscillating piston assembly and may dissipate gradually in the fluid surrounding the piston assembly and springs. The remaining frequencies from the explosion are transmitted along the tool string little by little each time the piston assembly collides with one of the terminal ends.

The piston assembly is also free to move in a radial direction as well as a longitudinal direction, since it is supported between the two terminal end housings by means only of first and second springs 30 and 50, allowing the oscillation of the piston assembly to absorb both longitudinal and radial frequency components from the shock wave.

Although a simple mass suspended between the first and second spring 30 and 50 would form an adequate oscillator, and is contemplated within the scope of this invention, the preferred embodiment of the shock absorbing tool comprises a piston assembly 40 suspended between the two springs. A shock wave acting to accelerate the mass on the springs between the two terminal end housings must therefore also act to compress the piston in the piston casing or expand it. The use of deformable rubber plugs disposed in the piston casing between the casing interior 416 and the piston rod 406 are acted upon by the piston 418 whenever the plunger is compressed and whenever it expands and therefore provide a further dampening force which acts to absorb or dissipate the shock wave. The presence of the piston assembly is advantageous since it acts to absorb a broad range of frequencies in the shock wave, not just those that correspond to integer multiples of the natural frequency of the spring oscillator.

The shock absorbing system described above, comprising two springs and a central floating mass or piston assembly, provides a number of advantages that prior art systems of single springs or single pistons do not. In particular single pistons suffer from an inability to react quickly enough to absorb the shock, with the piston assembly itself and any fluid in the piston assembly behaving almost like a solid for the transmission of the shock wave through the tool. In the present system there is no piston or plunger-like connection between the piston assembly and either of the terminal housings 10 and 20. The sole mechanical connection is through the springs 20 and 50. Consequently the preferred shock absorbing tool provides a free oscillator that can respond quickly to shocks. Furthermore, during its operation the oscillating element is subjected to less stress and pressure than known shock adsorbing tools, since having absorbed the shock it may re-transmit it in a controlled manner over time as it oscillates. Rather than absorbing the energy completely, the free oscillator acts to delay transmission of the energy along the tool string, and allows that transmission to be controlled.

The overall attenuation to the shock wave provided by the preferred shock absorber is the product of two attenuations: one from the action of the first spring 30 on the mass or piston assembly 40, and one from the second spring 50 onto a second mass, ie: the female end housing, if the shockwave is travelling from left to right. Each spring and mass acts as a low pass filter to the frequencies contained in the shock wave. Further spring and mass pairs may be added to the shock absorber to improve the attenuation of the shock wave as desired.

The preferred shock absorbing tool also comprises a stranded steel rope 70 attached to the sliding mount 72 within hollow bore 114 of male end terminal housing 10. The rope is fixed in place by the retaining pin 218 in the female end terminal housing 20. The sliding mount assembly accommodates some increase in distance between female end terminal housing and male end terminal housing as springs 30 and 50 expand, but limits that increase so that the springs are not extended beyond their elastic limit.

A tool string may be deployed in or retrieved from a bore hole by applying a longitudinal force to the wireline on which the tool string is suspended. Ordinarily the force that the wireline must support is of the order of 500 lbs. However, if the perforating guns, or indeed the tool string on which they were mounted, were to become jammed or stuck in the bore hole greater forces would be required to free them. These forces may range from 1000 lbs to 6000 lbs. Forces of such magnitude are likely to damage the first and second springs 30 and 50 of the shock absorbing tool by causing them to extend beyond their elastic limit or yield point. Thus, steel rope 70, capable of bearing such forces, is provided, in order to protect the springs. The length of the rope is such that it will take up the force on the wireline before the springs extend too much and become strained.

A stranded steel rope is preferred as it provides a poor helical shock path for transmission of the energy in the shock wave. Electric cable 60 and steel rope 70 pass along the inside of springs 30 and 50 via apertures provided in male end terminal housing, piston assembly and female end terminal housing.

Although the preferred embodiment of the invention has been described for use with a perforating gun it will be appreciated that it may be used in other down hole or pipeline applications to absorb shocks caused in other ways.

Many modifications may be made to the shock absorbing tool described and illustrated purely by way of example.

The invention claimed is:

1. A shock absorber apparatus for use as part of a tool string for use in bore holes and/or pipelines, said apparatus comprising:

spaced first and second end members, mounted for independent movement in relation to each other, and each having a connecting element for connecting to a neighbouring tool in a tool string;

a first spring connected to said first end member, and a second spring connected to said second end member; and a body freely mounted intermediate said first and second end members by said first and second springs coupling said body to said first and second end members respectively, said body being mounted such that a shock transmitted to said shock absorber apparatus causes said body to oscillate intermediate said first and second end members.

2. A shock absorber apparatus according to claim 1 in which said body includes a piston assembly comprising a piston plunger and a piston casing.

3. A shock absorber apparatus according to claim 1, comprising force transfer means to apply a force to the shock absorber apparatus in a direction along the tool string so that the apparatus may be pulled along the bore hole without extension of either of said first or second springs beyond their yield point.

4. A shock absorber apparatus according to claim 1, comprising a second body freely mounted intermediate said first and second end members by means of said second spring and by means of a third spring, said third spring coupling said body and the second body, and said second spring coupling said second body to said second end member.

5. A shock absorber apparatus according to claim 1, wherein said body can oscillate both longitudinally and transversely with respect to said first and second springs.

6. A shock absorber apparatus according to claim 1, wherein said first spring has a first end connected to said first end member and a second opposite end connected to said body, and said second spring has a first end connected to said second end member and a second opposite end connected to said body.

7. A shock absorber apparatus according to claim 2 in which said piston casing is fluid filled, or is filled with an open-cell polyurethane foam.

8. A shock absorber according to claim 2 in which deformable plugs are disposed inside said piston casing to oppose the motion of said piston plunger.

9. A shock absorber apparatus according to claim 2, comprising a retaining pin which connects said piston casing to said piston plunger such that they are prevented from rotating with respect to one another.

10. A shock absorber apparatus according to claim 8 in which said piston plunger is provided with an outwardly-extending radial flange, said flange acting upon said deformable plugs when said piston plunger is moved.

11. A shock absorber according to claim 3 in which said force transfer means comprises a cable attached to at least one of said first and second end members of the apparatus.

12. A shock absorber apparatus according to claim 11 in which said cable is attached to said at least one end member by means of a mount which can travel in a longitudinal direction.

13. A shock absorber apparatus according to claim 11 in which the cable is made of stranded steel.

14. A shock absorber apparatus for use as part of a tool string for use in bore holes and/or pipelines, the apparatus comprising:

spaced first and second end members, mounted for independent movement in relation to each other, and each having means for connecting to a neighbouring tool in a tool string; and a piston assembly mounted intermediate said first and second end members by first and second springs coupling the piston assembly to said first and second end members respectively, said piston assembly comprising a piston plunger and a piston casing and being mounted such that a shock transmitted to the shock absorber causes said piston assembly to oscillate backwards and forwards between said first and second end members, and causes motion of said piston plunger with respect to said piston casing.

15. A shock absorber apparatus according to claim 14, comprising an electrical wire for transmitting electrical power, and/or sensor data, wherein said piston assembly comprises apertures in said piston casing and said piston plunger for receiving said electrical wire and said electrical wire is connected between first and second electrical connectors mounted on said first and second end members respectively such that it passes through said apertures.

16. A shock absorber apparatus according to claim 14 in which said piston casing is fluid filled, or is filled with an open-cell polyurethane foam.

17. A shock absorber according to claim 14 in which deformable plugs are disposed inside said piston casing to oppose the motion of said piston plunger.

18. A shock absorber apparatus according to claim 17 in which said piston plunger is provided with an outwardly-extending radial flange, said flange acting upon said deformable plugs when said piston plunger is moved.

19. A shock absorber apparatus for use as part of a tool string for use in bore holes and/or pipelines, the apparatus comprising:

spaced first and second end members, mounted for independent movement in relation to each other, and each having means for connecting to a neighbouring tool in a tool string;

a body freely mounted intermediate said first and second end members by first and second springs coupling said body to said first and second end members respectively, said body being mounted such that a shock transmitted to the shock absorber apparatus causes said body to oscillate intermediate said first and second end members; and a cable attached between said first and second end members of the apparatus such that the apparatus may be pulled along the bore hole without extension of either of said first or second springs beyond their yield point.

20. A shock absorber apparatus according to claim 19, wherein said body has an aperture for receiving said cable, and said cable is mounted such that it passes along the inside of said first and second springs, through the aperture in said body.

21. A shock absorber apparatus according to claim 19, wherein said cable is attached to at least one of said first and second end members by means of a mount which has travel in a longitudinal direction.

* * * * *